United States Patent [19]

Schmidt

[11] 4,308,793

[45] Jan. 5, 1982

[54] APPARATUS FOR STAMPING INDICIA ON WORKPIECES MOVING IN A PATH

[75] Inventor: Ulrich Schmidt, Witten-Bommern, Fed. Rep. of Germany

[73] Assignee: Estel Hoesch Werke Aktiengesellschaft, Dortmund, Fed. Rep. of Germany

[21] Appl. No.: 100,540

[22] Filed: Dec. 5, 1979

[30] Foreign Application Priority Data

Dec. 21, 1978 [DE] Fed. Rep. of Germany ..... 2855291

[51] Int. Cl.[3] ..... B41F 17/24

[52] U.S. Cl. ..... 101/44; 101/41

[58] Field of Search ..... 101/44, 35, 41, 43, 101/333, 334

[56] References Cited

U.S. PATENT DOCUMENTS

| | | | |
|---|---|---|---|
| 2,646,746 | 7/1953 | Muller, Sr. | 101/35 X |
| 2,819,669 | 1/1958 | Glunz | 101/35 |
| 2,819,671 | 1/1958 | Porter, Jr. et al. | 101/44 |
| 2,935,015 | 5/1960 | Wilson et al. | 101/44 |
| 3,174,426 | 3/1965 | Boekeloo et al. | 101/42 |
| 3,299,804 | 1/1967 | Schueler | 101/35 |
| 3,641,930 | 2/1972 | Riddington | 101/35 |
| 3,771,448 | 11/1973 | Thompson et al. | 101/334 |
| 3,779,164 | 12/1973 | Study | 101/334 |
| 3,797,390 | 3/1974 | Marozzi et al. | 101/334 X |
| 3,804,016 | 4/1974 | Marozzi et al. | 101/333 |
| 3,877,367 | 4/1975 | Norwood | 101/44 |

*Primary Examiner*—Steven A. Bratlie
*Assistant Examiner*—Charles A. Pearson
*Attorney, Agent, or Firm*—Max Fogiel

[57] ABSTRACT

An apparatus for stamping indicia on workpieces moving in a path, in a combination which comprises a rail extending along but spaced from the path of workpieces movement, and a stamping unit which is movable along this rail to and from a rest position adjacent an end portion of the rail, and which includes a housing having a lower part which is movable transversely to the workpiece movement path. Cam and follower means are provided for biasing the lower part against a workpiece moving in the path, and an inking box adjacent the end portion of the rail is so positioned so as to be in tight engagement with the housing of the stamping unit when the unit is in its rest position, so as to be protected against ink evaporation and entry of contaminants.

13 Claims, 3 Drawing Figures

APPARATUS FOR STAMPING INDICIA ON WORKPIECES MOVING IN A PATH

BACKGROUND OF THE INVENTION

This invention relates to a stamping apparatus in general, and more particularly to an apparatus for stamping indicia on moving workpieces.

There are many applications in which it is important to stamp indicia on a workpiece, including workpieces which move in a path. One of the most problematical of these applications is the stamping of indicia on workpieces in rolling mills for steel and other metallic materials, where it is necessary to clearly indicate on each workpiece the particular type or quality of material. Heretofore, this has been accomplished by manually stamping the indicia upon the moving workpiece, e.g. a billet, strip or the like. However, aside from the fact that this is a rather labor-intensive procedure it is also quite dangerous for the workers involved because the workpieces are in movement and often are extremely hot. The apparently simplest solution to the problem, namely merely to replace manual stamping with mechanical stamping, is not readily possible because the ink used for the stamping purposes dries very quickly on the stamp (especially in view of the hot environment) and because the stamp itself tends to become soiled quite rapidly. One solution that has been proposed to the problem is the use of rollers which roll on the surface of the workpiece and are provided with the stamps; however, this has the disadvantage that it is not possible to change the indicia without at the same time also changing the rollers, because each roller incorporates only one specific stamp. Also, another disadvantage of this proposal is that it does not make it possible to affix the stamp with adequate position on a particular part of the workpiece. This is important because when profiled workpieces travel in a path in a rolling mill it is often necessary to change the indicia to be stamped onto them as when the profile changes, sometimes from workpiece to workpiece. Evidently, it is not possible to stop the rolling mill to exchange one roller for another having a different stamp.

Such rapid changes in the indicia to be stamped onto the workpieces are also necessary if for example one of the workpieces is found to contain some sort of flaw, because such a flaw must be immediately apparent from the indicia stamped onto the workpiece to assure that the workpiece is subsequently used only for certain applications for which they still fit in view of the detected flaw.

SUMMARY OF THE INVENTION

Accordingly, it is a general object of this invention to provide an improved apparatus which avoids the disadvantages of the prior art.

More particularly, it is an object of the invention to provide an improved apparatus for stamping indicia on workpieces moving in a path, which is not possessed of the prior-art disadvantages.

A still more particular object is to provide such an improved apparatus wherein the setting of the indicia to be stamped onto the workpiece can be changed rapidly and by remote control.

A concomitant object of the invention is to provide such an apparatus which is largely protected against drying of the ink and soiling of the stamp, even when the workpieces are still very warm as they are being stamped.

Still a further object of the invention is to provide such an apparatus which is able to apply the indicia to precisely determined parts of a workpiece and which will do so without objectionable smearing.

Finally, the apparatus according to the present invention must be simple and robust in construction so as to be capable of standing up to rough operating conditions, particularly those encountered in a rolling mill.

In keeping with the above objects, and with others which will become apparent hereafter, one aspect of the invention resides, in an apparatus for stamping indicia on workpieces moving in a path, in a combination which comprises a rail extending along but spaced from the path of workpieces movement, and a stamping unit which is movable along this rail to and from a rest position adjacent an end portion of the rail, and which includes a housing having a lower part which is movable transversely to the workpiece movement path. Cam and follower means are provided for biasing the lower part against a workpiece moving in the path, and an inking box adjacent the end portion of the rail is so positioned so as to be in tight engagement with the housing of the stamping unit when the unit is in its rest position, so as to be protected against ink evaporation and entry of contaminants.

The invention will now be described, for purposes of better understanding, with reference to a drawing showing an exemplary embodiment. It is to be understood, however, that only the appended claims define the scope of protection which is sought.

DESCRIPTION OF PREFERRED EMBODIMENTS

Figure 1:
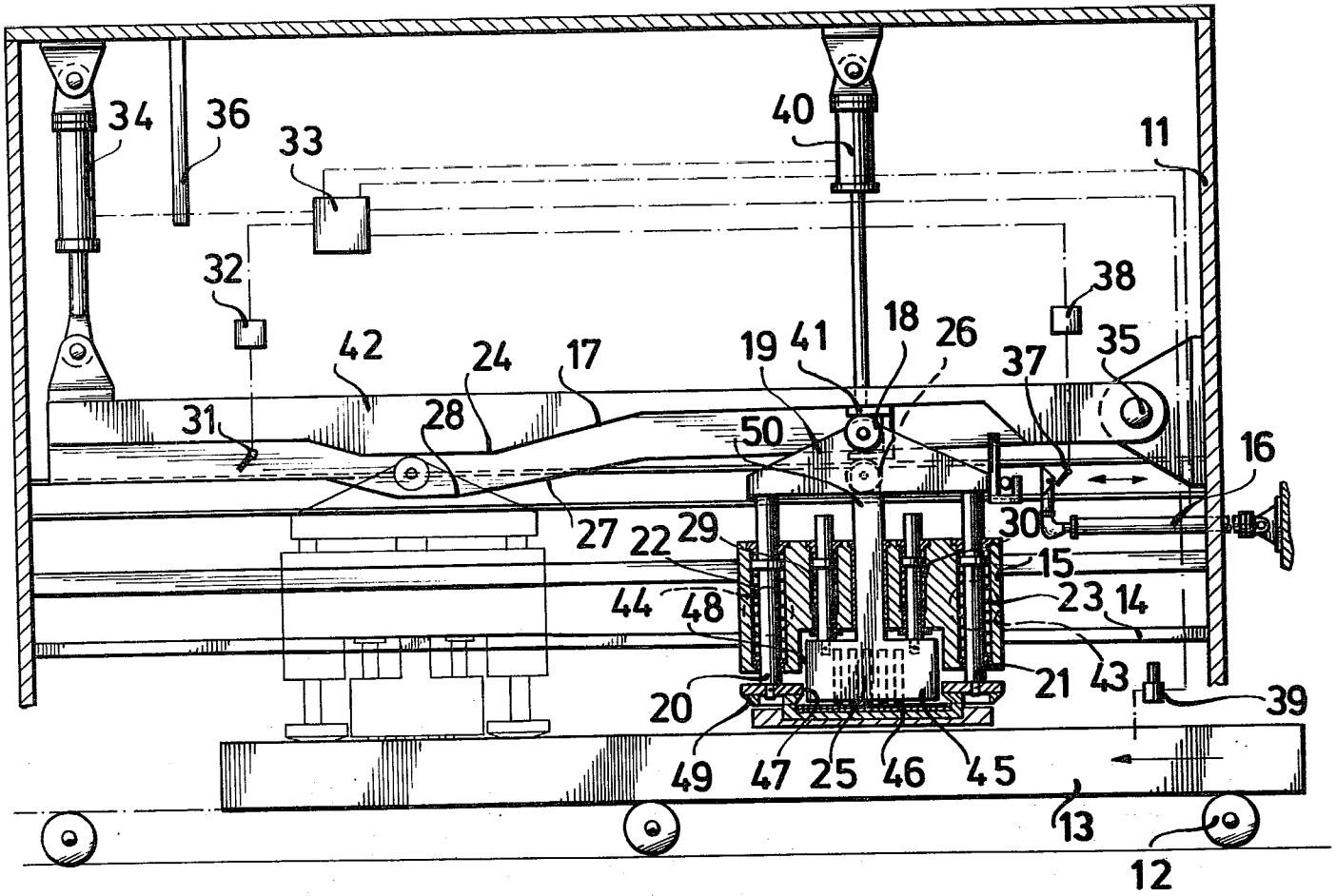
FIG. 1 is a partly sectioned side elevation, illustrating an apparatus embodying the invention.

Referring now to the drawing in detail it will be seen, as shown in FIG. 1, that an apparatus according to the invention comprises a frame 11 which straddles the roller bed 12 of a rolling mill. Workpieces 13 move on the roller bed 12 in the direction indicated by the arrow in FIG. 1; since the height of these workpieces may change from time to time the frame 11 is vertically and angularly adjustable, preferably manually. However, arrangements for this purpose have not been illustrated because they are known per se.

The apparatus has a stamping unit including a housing 15 coupled to a fluid-operated cylinder and piston unit 16 (usually pneumatic) which can move it lengthwise of the rail 14 extending parallel to the workpiece movement, with the aid of guide rollers 43 and 44. The stamping unit has a rest position shown at the right in solid lines in FIG. 1 and a working position shown at the left in thinner lines. During its movement from the rest position to the working position a cam follower 18 of the unit, which is connected via a traverse head 19 with a coupling 49 in the housing 15, moves along a cam track 17. The latter is fixedly connected with a rail 42 which also extends along the path of movement of the workpieces 13. Cam track 17 has a portion 24 which projects downwardly towards the workpiece path so that as the cam follower 18 moves along the track 17 it is deflected down towards the workpiece as it reaches the portion 24. This movement is transmitted to the traverse head 19 which is coupled with rods 20 and 21; as a result, these rods also move downwardly towards the workpiece and operate upon the coupling 49 which is connected to their lower ends, in a manner still to be described later. Springs 22 and 23 surround the rods 20 and 21 and have a permanent tendency to lift up the coupling 49, which they can achieve if the housing 15 moves beyond the operating position shown in FIG. 1 to the left of the same.

The housing 15 accommodates a stamp 25 which is known per se and which can be adjusted so as to set it for the stamping of different indicia, by means of a remote-control arrangement which is also known per se. For example, a remote-control arrangement such as that disclosed in German Allowed Application DE-AS No. 2,320,796, is suitable for use in conjunction with the invention.

The stamp 25 is connected via a rod 50 with a follower 26 which moves along a second cam track 27; the latter is also fixedly mounted on the rail 42 and extends lengthwise of the cam track 17. Like the cam track 17, the track 27 is also provided with a downwardly extending projection having a lowest point 28. As soon as the follower 26 enters into the downwardly extending projection and reaches the lowest point 28, the stamp 25 is therefore pressed against the upper surface of the workpiece 13 to apply indicia to the same. One end of the rail 42 is pivoted to the frame 11 at 35 whereas the other end is connected to a cylinder and piston unit 34 which is usually of the pneumatic type and which compensates for small height variations of the workpiece 13.

As particularly FIG. 1 shows, the cam tracks 17 and 27 extend upwardly again after the lowest points 24 and 28 are reached, so that after the stamp 25 has affixed indicia to the workpiece 13 and moves to the left beyond the lowest point 24 respectively 28, both the stamp and the coupling 49 are lifted off the workpiece 13 by the springs 29, 30 and 22, 23, respectively. A lever 31 is provided against which the follower 18 abuts when the unit moves left past the working position, and as the lever is thus moved it operates a switch 32 which is connected with a control mechanism 33 shown in diagrammatic form. When the switch 32 is operated the mechanism 33 supplies an impulse to the cylinder and piston unit 34, causing the same to retract its piston rod whereby the left-hand end of the rail 42 is lifted up, pivoting the rail about the pivot 35. This continues until an upper position is reached which is defined by the abutment 36; at the same time, the control 33 operates a magnetic valve of the cylinder and piston unit 16 so that the latter retracts and causes the stamping unit to be moved towards the right until it engages a pivot lever 37 which controls the switch 38 that is also connected to the control unit 33. When the switch 38 is closed (or opened, depending upon the type of switch used) the control unit 33 causes the cylinder and piston unit 34 to reverse its direction of movement and to lower the rail 42 until it is back in the operating position shown in FIG. 1.

Figure 2:
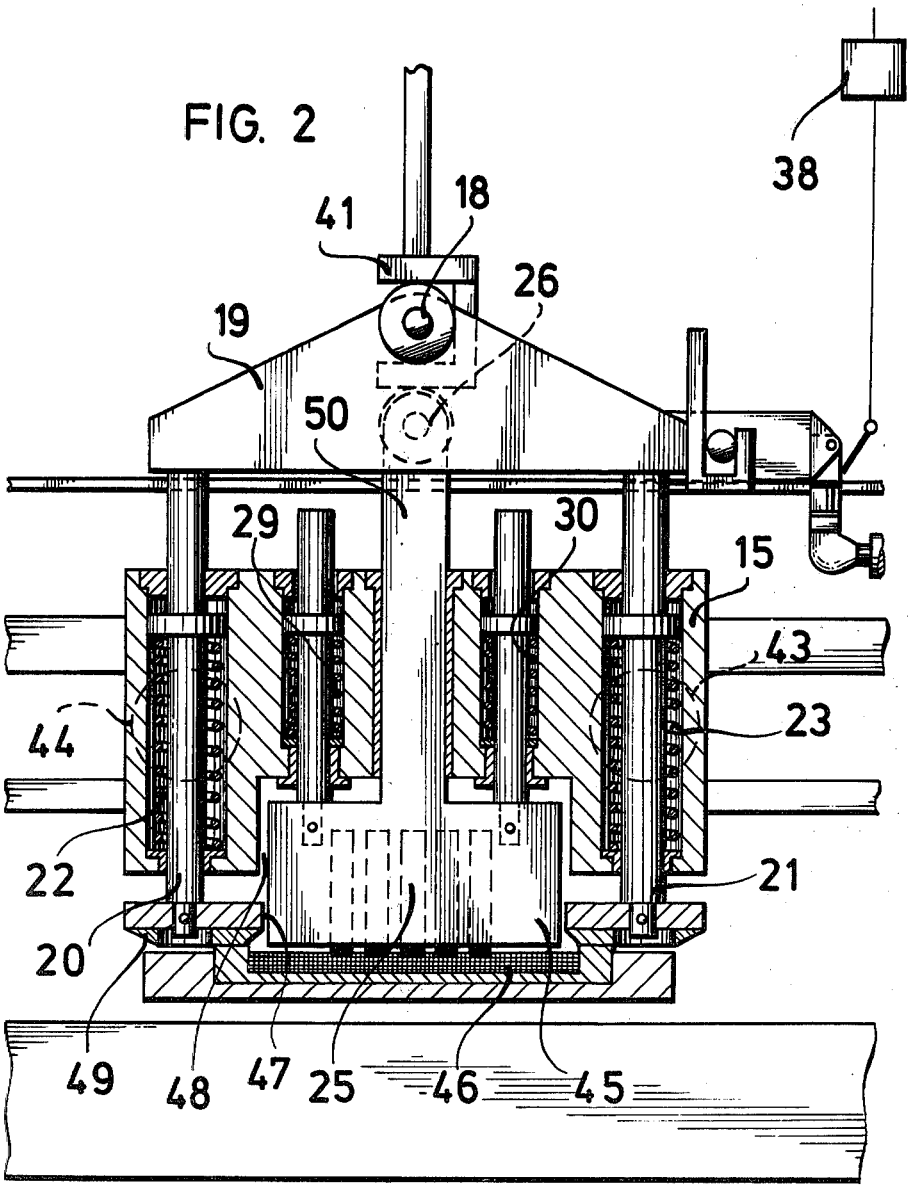
FIG. 2 shows the stamping unit of the apparatus of FIG. 1 located above the ink box, in a vertical section.
Figure 3:
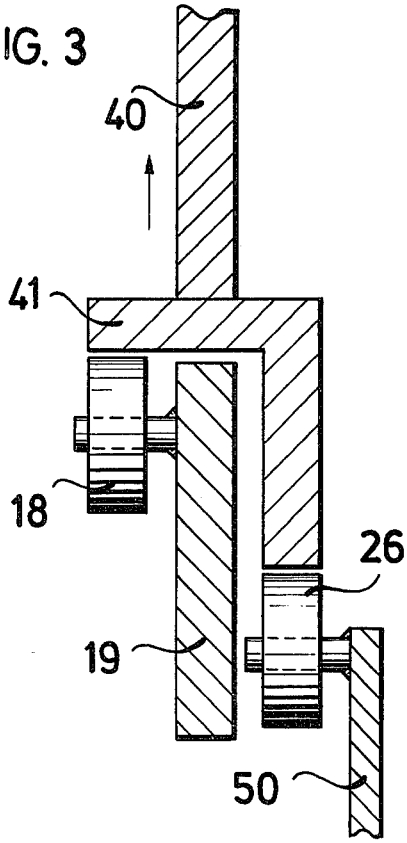
FIG. 3 is a sectioned side view of a component of the apparatus shown in FIGS. 1 and 2.

At the same time as the control unit 33 moves, it causes the piston 34 to extend (i.e. to move its piston downwardly in FIG. 1.), it also causes the pneumatic cylinder and piston unit 40 to move in the same direction and to apply pressure with its end portion 41 upon both the follower 26 and the follower 18 (see FIG. 2 and FIG. 3). This causes the stamp 25, which by this time is located above the stamp pad of the ink box 46, to be pressed against this stamp pad and the coupling 49 to descend and rest upon the edge of the box 46. The box 46 is thereby sealed rather well against evaporation or drying of the ink and against the entry of contaminants such as dust and the like. The only locations which are open and through which very small quantities of the ink can evaporate, are the very narrow guide gap 47 between the housing 45 and the coupling 49 and the gap 48 between the housing 45 and the housing 15.

The cylinder and piston unit 16 remains in its retracted right-most position until a new command for affixing of indicia is originated. As soon as such a command occurs, the piston unit 40 is first caused to move upwardly by command from the control unit 33, and the piston unit 16 then begins to move leftward after a small time delay relative to the upward retraction of the piston unit 40. A new stamping command may either be furnished to the control unit 33 manually (e.g. by an operator pushing a button) or it can be supplied automatically if the beam of an electric eye 39 is interrupted by the leading edge of a workpiece 13. This latter possibility is shown in FIG. 1 where the electric eye unit 39 seems to be connected to the control unit 33, but of course this does not preclude that an additional manual control circuit be provided, i.e. a button which an operator can push if the electric eye 39 is not in use or should be defective.

The control unit 33 is so constructed that it includes a relay which is activated when the follower 18 presses even briefly against the lever 31, because this causes the electric current for the relay to be switched on. Once energized, the relay is self-holding, i.e. it continues to receive electric current so that it remains activated even when no electricity continues to flow through the switch 32. As long as the relay remains activated, other contacts of the relay supply the electric current for the magnetic valve which in turn controls the supply of compressed air for the upward movement of the pneumatic cylinder and piston unit 34. Still other contacts of the relay at the same time supply electric energy for the magnetic valve which channels compressed air to the left side of the pneumatic cylinder and piston unit 16. The relay in the unit 33 continues to hold until its winding is shorted through a known per se shunt circuit, which occurs when the traverse head 19 engages the lever 37. Once the relay releases, the current for the magnetic valve is energized which causes air to be supplied to the cylinder and piston unit 34 for the downward movement of the piston thereof, and at the same time another magnetic valve is energized which channels air to the piston unit 40 for the downward movement of the same.

A current pulse from the electric eye unit 39 or from a hand operated button or switch causes a second self-latching relay to be activated, which switches on the magnetic valve controlling the supply of compressed air to the cylinder and piston unit 40 for upward movement of the same, and in addition, a third relay is switched on with a slight time delay, which in turn operates the magnetic valve for the supply of compressed air to the pneumatic cylinder and piston unit 16 so that the same moves leftward from the rest position to the operating position in FIG. 1. This third relay continues to remain energized until the follower 18 abuts the lever 31 and thereby causes the third relay to be short circuited.

In addition, the control unit 33 incorporates a time delay circuit which is known per se and through which the operation of the magnetic valve for a supply of air to the cylinder and piston unit 16, causing the same to move left from the rest position to the operating position, can be time delayed slightly beyond the operation of the unit 40.

It will be appreciated that the relays can be replaced with transistorized circuits having the same functions as the relays, and that it is also possible to operate the valves for the admission and expulsion of compressed air to the various cylinder and piston units by means of appropriate drives in conjunction with the movement of housing 15 of the stamping unit, analogous to the valve controls known from internal combustion engines.

The speed of movement of the housing 15 and the path to be traversed by the housing 15 before it reaches the operating position shown in FIG. 1, are so related to one another that when the follower 18 reaches the point 24 and the follower 26 reaches the point 28, the speed of movement of the housing 15 is approximately the same as the speed of movement of the workpiece. Any small remaining speed differentials are eliminated by the fact that the lower part of the housing 15 is pressed against the workpiece prior to the affixing of the indicia thereto, and thus acts in the manner of a friction clutch, i.e. the stamping unit is either slowed up or slowed down, depending upon the speed of movement of the workpiece. The pressing of the housing 15 against the workpiece may also be affected via an electromagnet, but the use of pneumatic units is currently preferred because they are particularly simple and reliable in operation, and the speed can be readily adjusted by the use of a regulatable valve.

It is frequently desired that the indicia be affixed to the workpiece at a point which is rearwardly spaced from the leading end of the workpiece by a distance that is to be equal from workpiece to workpiece, and more over that the affixing be automatic. According to the invention this is achieved in that the drive for the movement of the housing 15 is time delayed via the time delay mechanism incorporated in the control unit 33 and mentioned before, by relation to the sensing of the leading end of the workpiece via e.g. the electric eye unit 39 or a suitable mechanical equivalent. The stamp 25 can also be moved against the workpiece by its own drive, for example a pneumatic drive or an electromagnet, and such a drive may be actuated by engagement of the housing 15 with a lever after the followers 18, 26 press the lower end of the housing 15 against the workpiece.

Of course, the follower 26 could be omitted, but its use makes the construction still more simple and operationally reliable, and in this connection it should be noted that the lowest point 28 is slightly offset in the forward direction of movement from the lowest point 24 so that it is reached somewhat later, meaning that the stamp 25 is pressed against the workpiece after the lower end of the housing 15 has already been pressed against the same. To prevent smearing of the indicia just impressed upon the workpiece it is advisable that the lower edges of the housing 15 be somewhat spaced above the workpiece at the time of stamping. For this purpose, the lower part of the housing has edge portions extending crosswise of the path, and these edge portions are spaced from the workpiece when the stamping unit applies indicia thereto.

In accordance with the present invention, furthermore, the leading end detector for a workpiece may be mounted for displacement in direction transversely towards and away from the path in which the workpiece moves. The detector may also be in the form of a mechanical feeler. The stamping unit may have, moreover, an indicia former in the housing, and a common drive may be used for biasing the lower part towards a workpiece and for pressing the indicia former against an ink pad in the ink box. The common drive may be mounted in the apparatus at a location above the rest position of the stamping unit.

Although the invention has been illustrated and described with reference to a currently preferred embodiment, it should be understood that it is not so limited and that various modifications may be made not departing from the intent and scope of the invention. The scope of the protection sought is therefore to be considered defined only by the appended claims.

What is claimed is:

1. An apparatus for stamping indicia on workpieces moving in a path, comprising a rail extending along but spaced from the path of workpiece movement; a stamping unit movable along said rail to and from a rest position adjacent an end portion of the rail and including a housing having a lower part which is movable transversely to said path; cam and follower means for biasing said lower part against a workpiece moving in said path; and an inking box adjacent said end portion of the rail and in tight engagement with said housing when said unit is in said rest position, so as to be protected against ink evaporation and the entry of contaminants; said cam and follower means comprising a cam track also extending along said path and having a portion projecting toward the same, and a follower connected to said lower part and tracking said cam track; means mounting said cam track for displacement towards and away from said path, and displacing means for effecting such displacement of said cam track.

2. An apparatus as defined in claim 1, including delay switch means for decelarating said stamping unit.

3. An apparatus as defined in claim 2 wherein stamping is initiated by photoelectric cells, the stamp pad being sealed when not in use.

4. An apparatus as defined in claim 1, further comprising adjustable indicia-forming means in said housing, and means for operating said indicia-forming means responsive to and upon biasing of said lower part against a workpiece.

5. An apparatus as defined in claim 1, and further comprising drive means for moving said unit lengthwise of said rail from said rest position towards said portion of said cam track.

6. An apparatus as defined in claim 5, said drive means comprising a drive unit operative to accelerate said stamping unit from said rest position in direction toward said portion of the cam track, so that the stamping unit travels at a speed which is at least substantially equal to that of the workpiece by the time it reaches said portion of said cam track.

7. An apparatus as defined in claim 5, said drive means comprising a pneumatic drive for said stamping unit.

8. An apparatus as defined in claim 1, further comprising drive means for moving said stamping unit from said rest position toward said portion of said cam track; and control means coupled with said drive means and said displacing means for reversing the movement of said stamping unit and the displacement of said cam track toward said path when the stamping unit passes in said direction beyond a predetermined position.

9. An apparatus as defined in claim 8, said control means comprising a means for deactivating said drive means, and for reversing and deactivating said displacing means in response to arrival of said stamping unit at said rest position.

10. An apparatus as defined in claim 1, further comprising indicia-forming means in said housing; and a follower connected with said indicia-forming means and engageable with a cam for displacement of said indicia-forming means into contact with a workpiece.

11. An apparatus as defined in claim 1, said lower part of said housing having edge portions extending crosswise of said path and being spaced from the workpiece when said stamping unit applies indicia thereto.

12. An apparatus as defined in claim 1, said unit including indicia-forming means in said housing; and pneumatic cylinder and piston means for biasing said lower part towards a workpiece and for pressing said indicia-forming means against an ink pad in said ink box.

13. An apparatus as defined in claim 12, said pneumatic cylinder and piston being mounted in said apparatus at a location above said rest position of said stamping unit.

* * * * *